US005722494A

United States Patent [19]

Landeck et al.

[11] Patent Number: 5,722,494

[45] Date of Patent: Mar. 3, 1998

[54] STACKED TEMPLATE SUPPORT STRUCTURE

[75] Inventors: Chris R. Landeck; Frank L. Jones; Randall G. Scott, all of East Kalimantan, Indonesia

[73] Assignee: Union Oil Company of California, El Segundo, Calif.

[21] Appl. No.: 544,700

[22] Filed: Oct. 18, 1995

[51] Int. Cl.[6] ..... E21B 7/128

[52] U.S. Cl. ..... 175/7; 166/349; 166/366; 175/10; 405/227

[58] Field of Search ..... 175/7, 10, 9; 405/227, 405/228, 224.2, 211; 166/366, 349, 342

[56] References Cited

U.S. PATENT DOCUMENTS

| | | | |
|---|---|---|---|
| 3,004,612 | 10/1961 | Kofahl | 175/7 |
| 3,050,139 | 8/1962 | Hayes | 175/7 |
| 3,125,171 | 3/1964 | Stewart, III | 175/9 X |
| 3,316,984 | 5/1967 | Jones | 175/7 |
| 3,741,294 | 6/1973 | Morrill | 166/358 X |
| 4,109,478 | 8/1978 | Gracia | 166/366 |
| 4,192,383 | 3/1980 | Kirkland et al. | 166/341 |
| 4,227,831 | 10/1980 | Evans | 175/7 X |
| 4,510,985 | 4/1985 | Arnim, II et al. | 175/7 |
| 4,611,661 | 9/1986 | Hed et al. | 166/349 X |
| 4,739,840 | 4/1988 | Cox | 175/9 |
| 4,740,107 | 4/1988 | Casbarian et al. | 405/211 |
| 4,822,212 | 4/1989 | Hall et al. | 405/227 |
| 4,907,657 | 3/1990 | Cox | 175/9 |
| 4,932,811 | 6/1990 | Folding | 405/227 |
| 4,958,960 | 9/1990 | Turner et al. | 175/7 X |
| 5,012,875 | 5/1991 | Casbarian et al. | 175/9 |
| 5,356,239 | 10/1994 | Canton | 405/227 |
| 5,379,844 | 1/1995 | Glasscock et al. | 166/358 |

OTHER PUBLICATIONS

Craig, Michael J. K., Minimum Offshore Structures Cost Less, Pose Higher Risk, *Oil & Gas Journal*, Jul. 17, 1995, pp. 33–42.

*Primary Examiner*—Hoang C. Dang

*Attorney, Agent, or Firm*—William O. Jacobson; Yale Finkle; Gregory F. Wirzbicki

[57] ABSTRACT

One or more bracing structures are placed at an underwater mud line location. The bracing structure(s) are first used as a template to guide the offshore drilling and placement of well tubulars. After drilling through the template is completed, at least one of the bracing structures is raised and attached to the well tubulars to act as a support structure for bracing between the well tubulars. The uppermost raised structure typically acts as a working platform or a support for a working platform. If more than one bracing structure is used, they are stacked one on top the other at the underwater location until the well tubulars are in place and one or more of the structures are raised and spaced apart.

33 Claims, 4 Drawing Sheets

STACKED TEMPLATE SUPPORT STRUCTURE

FIELD OF THE INVENTION

This invention relates to offshore well structures and methods for installing such structures. More specifically, the invention provides bracing for offshore wells and methods for installing such bracing.

BACKGROUND OF THE INVENTION

Offshore exploration wells are typically drilled into an underground formation which is hoped to contain commercially recoverable reservoir fluids. These wells are typically drilled from a temporary platform or structure such as a floating or jackup drilling rig. After an exploratory well is drilled and tested, portions of the well tubulars may be removed, the well shut in, and the floating or jackup rig removed. If such testing has shown the that the formation is capable of commercial fluid production, a more permanent well platform structure is typically fabricated onshore, transported to the offshore well site, placed on the ocean floor, and anchored by underground pilings. The purpose of the typical permanent structure is to support completed well(s) and equipment required to route the produced fluids to a departing pipeline. If the exploratory well can be used commercially, it is typically attached to the subsequently installed permanent platform structure. Additional production wells can then be drilled from the permanent platform structure adjacent to the originally drilled exploration well (s).

The typical offshore platform structure can be very costly. In addition, platform fabrication and installation can result in significant delays in producing the reservoir fluids. Oil and gas producers are continually seeking ways to reduce costs and time delays involved in producing such fluids.

SUMMARY OF THE INVENTION

The present invention accomplishes this and other goals by using one or more bracing-template structures initially placed or stacked on the mud line under water. The structures include duct-like guides for well tubulars used during drilling. The process of drilling and running tubulars creates a cemented well conductor that extends from below the mud line through the duct-like guides to a surface-located drilling platform. After drilling, at least one bracing-template structure is raised, e.g., the duct-like guides sliding relative to the well conductor to a position which varies with water depth. The raised structure or structures are attached to the well conductors to act as bracing between the well conductors. The uppermost raised structure is typically attached to the well conductors above the water line and acts as a working production platform or support for a working production platform. The production platform is capable of supporting a limited amount of equipment necessary for commercial production of reservoir fluids including outgoing or transfer pipelines.

The bracing-template structure and the method of installing the structure are especially applicable for use on or in combination with offshore production wells located in relatively shallow water, e.g., wells in less than 200 feet of water, and/or wells in a protected location such as a bay or other location not exposed to excessive environmental loads, e.g., storm waves. Use of the invention reduces or eliminates the need for pilings and decreases platform costs, allowing a rapid conversion of successful exploration results into commercial production using well conductors as structural members.

BRIEF DESCRIPTION OF THE DRAWINGS

In these figures, it is to be understood that like reference numerals refer to like elements or features and the figures are not necessarily to scale.

DETAILED DESCRIPTION OF THE INVENTION

Figure 1:
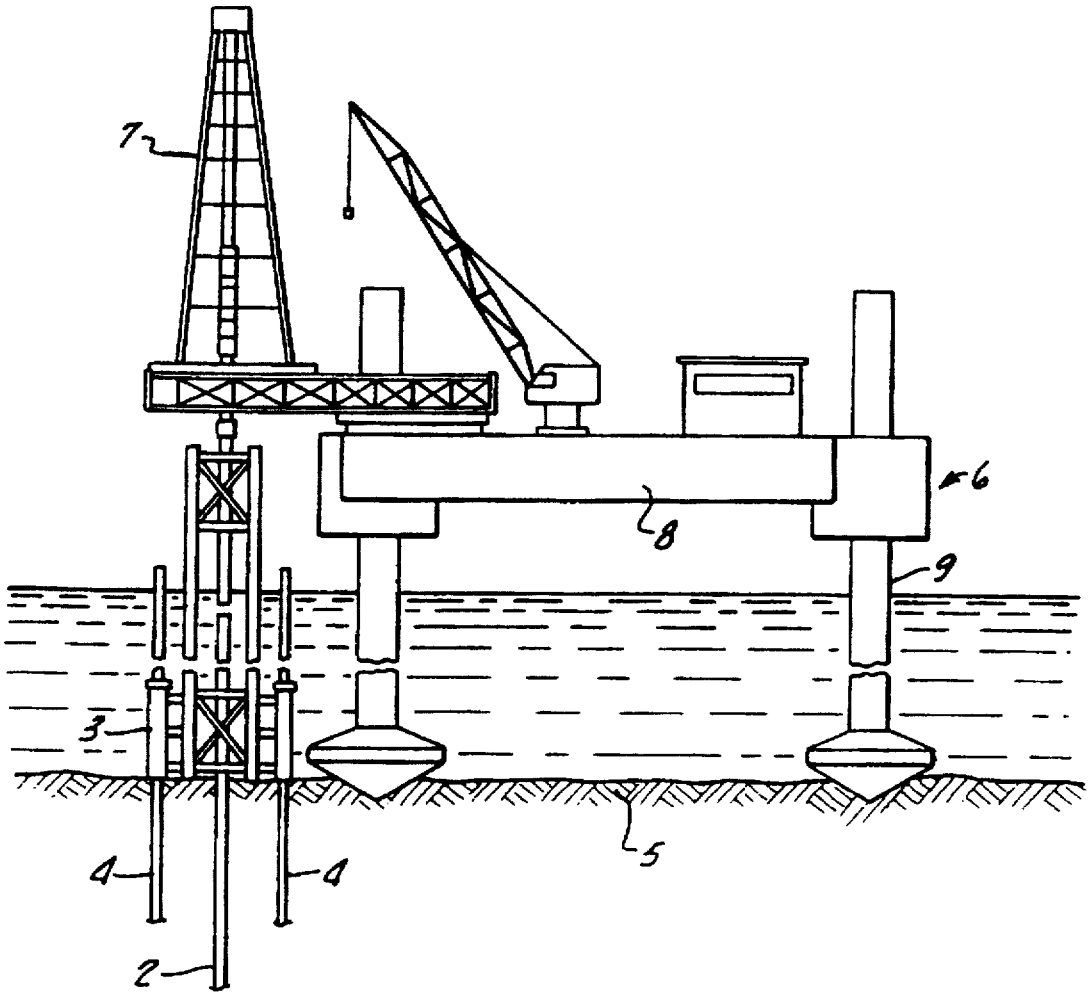
FIG. 1. (PRIOR ART)
FIG. 1 shows a side view of a prior art jackup platform used during the drilling of a well.

FIG. 1 shows a side view of an offshore well 2 and a prior art structural support 3 for the well. The structural support 3 is anchored by pilings 4 driven into an underground formation 5. A jackup drilling rig 6 includes a skid mounted derrick and rotary table assembly 7 mounted on a platform 8 supported above the mean sea level (MSL) on legs 9. Only the upper and lower segments of well 2, legs 9, and pilings 4 are shown in FIG. 1.

Figure 2:
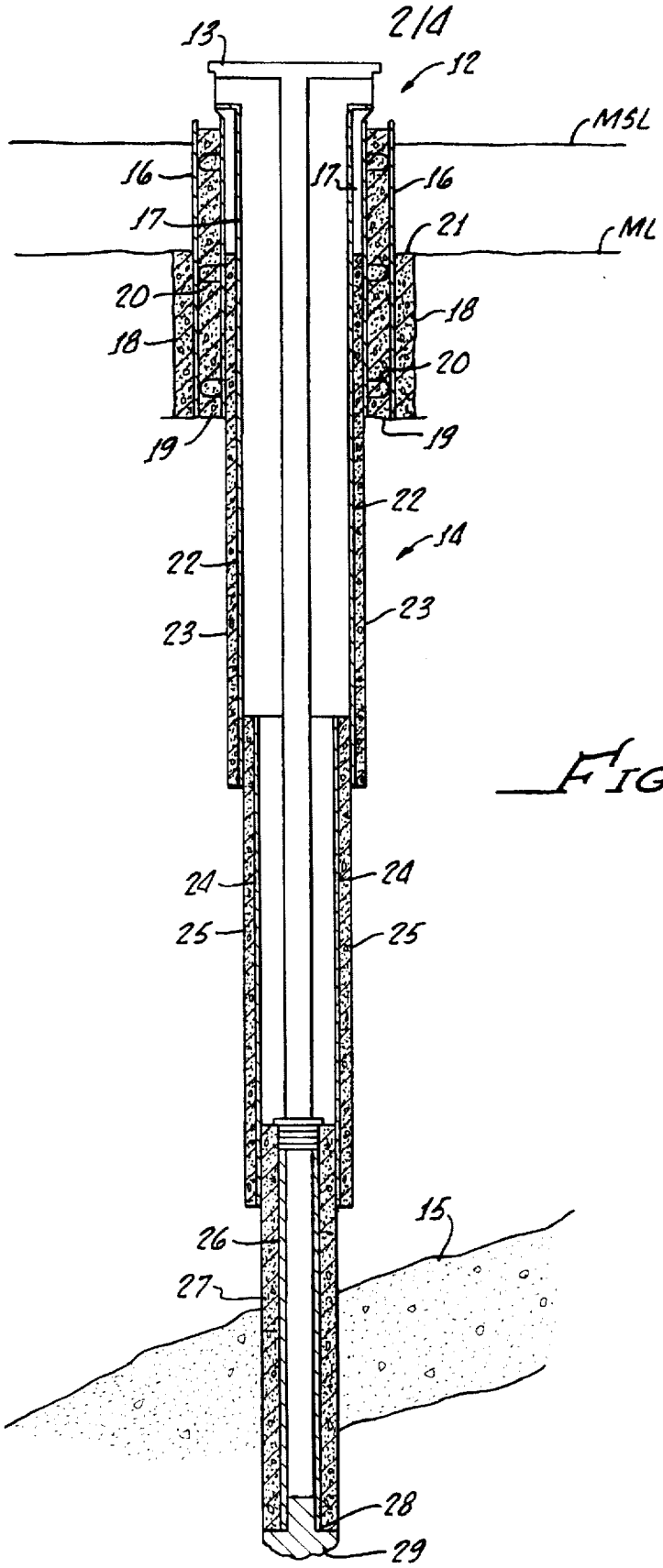
FIG. 2 shows a cross sectional view of an offshore production well.

FIG. 2 shows a cross sectional view of an offshore production well 12, including associated well tubulars, capable of supporting additional structure and used in an embodiment of the invention. The well tubulars extend from a wellhead 13 generally downward through an underground borehole or wellbore 14 (having several portions with different borehole diametrical dimensions) to penetrate a fluid-containing reservoir or underground formation 15. The wellhead 13 is located above the mud line (ML) and typically above the mean sea level (MSL), e.g., at least about 25 feet above MSL in the embodiment shown. The location above MSL avoids damage to the wellhead caused by unusual ambient conditions, e.g., a tidal surge or storm waves. Wellhead heights above ML can typically range from an underwater location to a location about 30 feet above MSL. During drilling, the well tubulars may extend further above the mean sea level, e.g., about 85 feet above mean sea level to a rotary table on a jackup rig.

In the embodiment shown, a radially outermost well tubular or well conductor 16 and the next innermost well tubular or surface casing 17 both extend from near the bottom of an upper wellbore portion 18 to above the mean sea level (MSL). The annular space between the well conductor 16 and surface casing 17 is substantially filled with a first portion of cement 19 and one or more positive centralizers 20, and the resultant assembly acts as a structural member. The well conductor 16 and surface casing 17, interior cement portion 19, and centralizers 20 form an anchored support assembly and protection for other well tubulars, e.g., a fluid conduit. The well conductor 16 and surface casing 17 extend from above the MSL generally downward to the bottom of wellbore portion 18, e.g., about 160 feet below mud line (ML) or about 350 below the rotary table in a preferred embodiment. The well conductor 16 and surface casing 17 depths below ML are typically site specific, e.g., dependant upon mud/underground load limitations, but typically range from about 100 feet below ML to about 1000 feet below ML. The bottom of the surface casing 17 may also extend below the bottom of the well conductor 16, e.g., surface casing 17 preferably extending to at least about 500 feet below the mud line.

A preferred structural or well conductor 16 for the embodiment shown is a string of nominal 30 inch diameter, grade X52, 1 inch thick well tubular sections or other heavy weight pipe sections. A thinner and smaller-diameter well conductor may be acceptable for alternative embodiments of the invention, e.g., a nominal 26 inch diameter, grade B, ¾ inch thick well tubular. Another embodiment only requires a single well conductor or surface casing, avoiding the need for interior cement portion 19, centralizers 20, and a second protective well tubular or surface casing 17 extending to the MSL. Larger diameter and thicker outer conductors are also possible, but practical considerations (e.g., maximum lifting load of a jackup platform) may limit the diameter and thickness of the well conductor 16. Typical nominal diameters of well conductors range from about 20 to 42 inches and about 0.5 to 1.5 inches in thickness.

The well conductor 16 is also cemented to the larger-diameter wellbore portion 18 with outer cement portion 21. The outer cement portion 21 extends downward from at or near the mud line (ML) to the bottom of the larger-diameter wellbore portion 18. The bottom of wellbore portion 18 is typically near or co-located with shoe portions of the well conductor 16 and surface casing 17. Various cement compositions for the cement portions can be used, e.g., a lightweight cement composition with acceptable compressive strength. Other acceptable cement compositions include additives which facilitate proper cement placement and curing.

A preferred surface casing 17 for the embodiment shown is a nominal 20 inch diameter well tubular or drill pipe. Heavy weight tubulars may also be used for the surface casing string 17.

A variety of centralizers 20 can be used between the well conductor 16 and surface casing 17 to maintain a generally constant annulus while allowing a cement slurry to move substantially unhindered in the annulus. If the bottom of the surface casing 17 extends below the bottom of well conductor 16, the annulus or annular space where centralizers 20 are installed is defined as the portion of surface casing 17 adjacent to the well conductor 16. A preferred variety of centralizers 20 is a rigid centralizer made of plate steel with 3 to 4 contact points having an outer diameter approximately ¼ inch less than the inner diameter of the well conductor 16 and which centralizers are welded onto the surface casing 17, but standard bow type or positive rigid centralizers may also be used. The centralizers 20 are typically spaced apart at about every 40 to 45 feet in a preferred embodiment, but spaced apart distances may typically range from about 10 to 100 feet in other embodiments.

A well casing 22 extends from at or near the wellhead 13 downward to about 2000 feet below the rotary table in a preferred embodiment. The well casing 22 is cemented to the casing borehole portion 23 of borehole 14 and to a portion of the interior of the surface casing 17 extending from near the mud line (ML) downward to near a surface casing shoe. A preferred well casing 22 for the embodiment shown is a nominal 13⅜ inch diameter, K-55, 68 pounds per foot (ppf) well tubular or drill pipe. Although larger and thicker well casings are possible in alternative embodiments, practical considerations typically limit the well casing 22 to a range of about 9⅝ to 20 inches in nominal diameter and about 0.375 to 1 inch in thickness.

An outer liner 24 extends from an underground location proximate to a well casing bottom or well casing shoe of well casing 22 downward to an outer liner shoe located about 8000 feet below the rotary table in a preferred embodiment. The outer liner 24 is cemented to a second casing borehole portion 25 of wellbore or borehole 14 and to a portion of the interior of the well casing 22 proximate to the well casing shoe about 2,000 feet below the rotary table. A preferred outer liner 24 for the embodiment shown is a nominal 9⅝ inch diameter, N-80, 47 pounds per foot (ppf) well tubular or pipe. Although larger and thicker outer liners are possible for other embodiments, practical considerations typically limit the outer liner 24 to a range of about 7 to 13⅜ inches in nominal diameter and about 0.375 to 0.625 inches in thickness. Another alternative is to run the outer liner 24 as a string of casing attached to the wellhead 13.

An inner liner 26 extends from an underground location proximate to the bottom or outer liner shoe of the outer liner 24 downward to an inner liner shoe 28 and well bottom 29 located about 12,500 feet below the wellhead in a preferred embodiment. The inner liner 26 is cemented to the outer liner borehole portion 27 of wellbore 14 and to a portion of the interior of the outer liner 24 proximate to the outer liner shoe about 8,000 feet below the wellhead. A preferred inner liner 26 for the embodiment shown is either a nominal 7 inch diameter, K-55, 26 pounds per foot (ppf) well tubular or pipe or a nominal 3½ inch diameter, N-80, 9.2 pounds per foot (ppf) well tubular or pipe. Although larger and thicker inner liners are possible for other embodiments, practical considerations typically limit the inner liner 26 to a range of about 2⅞ to 9⅝ inches in diameter and about 0.25 to 0.5 inches in thickness.

The inner liner 26 is located at least in part within a fluid containing formation 15. The fluid is typically oil or natural gas, but may also be water, slurry, geothermal steam, or other manmade or naturally occurring fluids. Although the well bottom 29 is shown plugged with cement, the plug may be drilled out or otherwise removed to allow deeper drilling or formation fluids to flow to the wellhead 13. Once the plug is removed, the formation fluids may naturally flow toward the wellhead 13, but the flow may also be pumped or otherwise stimulated. In alternative embodiments, the outer and/or inner liners 24 & 26 and associated cement portions in borehole portions 25 & 27 may be perforated or slotted along their length(s), allowing formation fluids to flow to the wellhead 13 without removing the plug at the well bottom 29. Alternative embodiments may also allow fluids from the wellhead 13 to flow downward and be injected into the formation 15.

Figure 3:
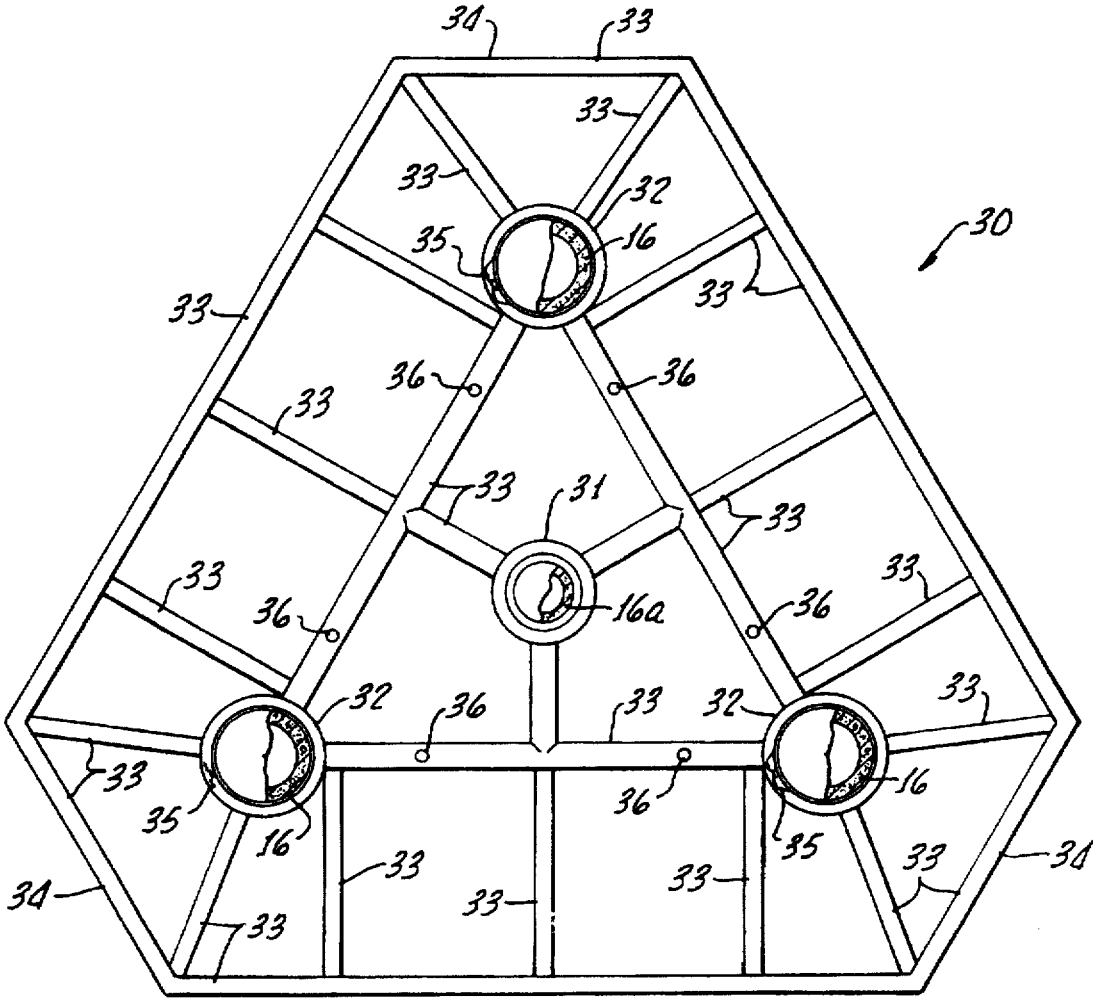
FIG. 3 shows a top view of an embodiment of an uppermost template and bracing structure.
Figure 4:
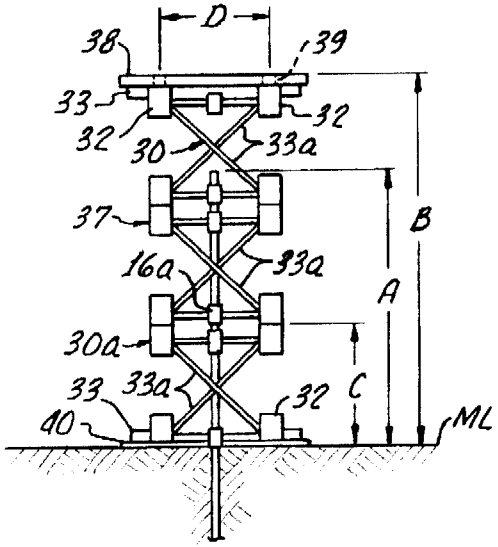
FIG. 4 shows a side view of a stacked structure.

FIG. 3 shows a top view of an embodiment of an uppermost bracing-template structure 30 which forms part of the stacked structure shown in FIG. 4. An exploratory duct-like guide 31 is sized to enclose or slidably contact a portion of the exterior surface of exploratory well tubular 16*a*. Larger diameter or production duct-like guides 32 are sized to enclose or slidably contact a portion of the exterior surface of each of the well conductors 16 or the exterior portions of other production well tubulars. When compared to production well conductor sizes, the exploration well tubular 16*a* and guide 31 typically have smaller diameters in order to minimize exploration costs. Once exploratory well testing confirms the commercial potential for fluid production or injection, several production wells can be drilled using larger-diameter, production well tubulars 16.

The tripod-shaped, uppermost bracing-template structure 30 laterally supports exploration well tubular 16*a* and production well tubulars 16. In a preferred embodiment, braces, struts, or beam segments 33 interconnect the three production duct-like guides 32 to form the tripod-shaped structure 30. Some of the braces 33 also extend outward from the production guides 32 to provide support for a working platform (see item 38 in FIG. 4) which is part of or may be placed on the uppermost structure 30. Although the braces 33 of a preferred embodiment are composed of tubular steel members of various lengths, which members have nominal diameters of 6 to 8 inches and a nominal wall thickness of 0.28 inches, a wide range of other bracing, channel, strut, or beam materials having various lengths, sizes, shapes, and thickness can also be used to form different platform and bracing-template structure geometries.

The tripod-shaped, uppermost bracing-template structure 30 has a six-sided geometry (as viewed from the top) formed by truncating at what otherwise would be triangular corners 34, saving structural weight and cost. The resulting mostly triangular-shaped (from a top view) bracing formed near each truncated corner 34 also provides additional lateral support for the production well tubulars 16 when the well tubulars are attached to the bracing-template structure 30.

For a middle or intermediate bracing-template structure, typically not located at or near the top or bottom of a stack (e.g., see item 37 in FIG. 4) and/or not attached to a working platform (e.g., see item 38 in FIG. 4) or a mud mat (e.g., see item 40 in FIG. 4), the braces or struts 33 typically have a similar configuration except that the braces do not extend substantially beyond the space between production duct-like guides 32. For the three production well or tripod configuration shown in FIG. 3, the braces 33 of a middle or intermediate bracing-template structure would form a more triangular-shaped and smaller structure (from a top view), not the truncated, six-sided geometry shown in FIG. 3. Braces 33 outside the area between production duct-like guides 32 of the upper bracing-template structure shown are primarily to support attached elements, e.g., a working platform.

Each of the three production duct-like guides 32 has means 35 for attaching the structure 30 to the production well tubulars 16. The means 35 for attaching is preferably a conventional clamping mechanism, e.g., a band clamp as shown, but alternative means for attaching include: welds, bolts, pins, and shoulder-like supports formed by tubular fittings.

Prior to attachment, the production duct-like guides 32 allow production well tubulars 16 to act something like slide rails for the bracing-template structure. The well conductors 16 may slidably contact or be traversed generally perpendicular to the plane of FIG. 3, i.e., the uppermost bracing-template structure 30 can move relative to the production well tubulars 16 in a generally up and down direction. In addition, the production wells can be drilled and well tubulars installed using the (unattached) production duct-like guides 32 as template guides before the bracing structure is raised, i.e., the production well tubulars can move relative to the uppermost bracing-template structure 30 and any other bracing-template structures on which structure 30 is stacked (see FIG. 4) in a generally up and down direction.

The uppermost bracing-template structure 30 also includes alignment receptor holes or other means 36 for stackably mating or aligning the structures when bracing-template structures 30, 37, and **30*a* are stacked as shown in FIG. 4. The downward facing holes 36 on uppermost structure 30 mate with upward facing pins or other projections (not shown on FIG. 3) attached to middle bracing-template structure 37. This type of means 36 for stackably mating or aligning also allows the bracing-template structures (e.g., items 37 and 30*a* in FIG. 4) to be placed on top of one another so that the duct-like guides are located to align portions of well tubulars 16, i.e., allowing the stacked structures 30, 37, and 30*a*** to act as aligned drilling templates.

Alternative means for stacking/aligning can be integral with the bracing-template structures, e.g., conical or telescoping duct-like guides, or can be other separate alignment structures, e.g., alignment clamps or bolts which are unsecured or ruptured when stacking is no longer desired. Still other alignment means include: laser beams, electronic transponders, and the exploratory well tubular **16*a* and related duct-like guide 31**.

Figure 6:
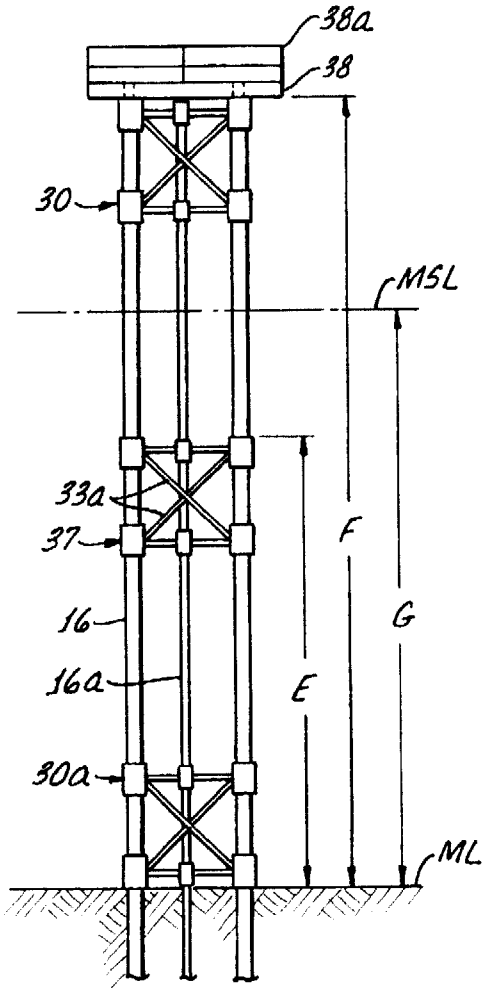
FIG. 6 shows a side view of a fully raised structure.
Figure 5:
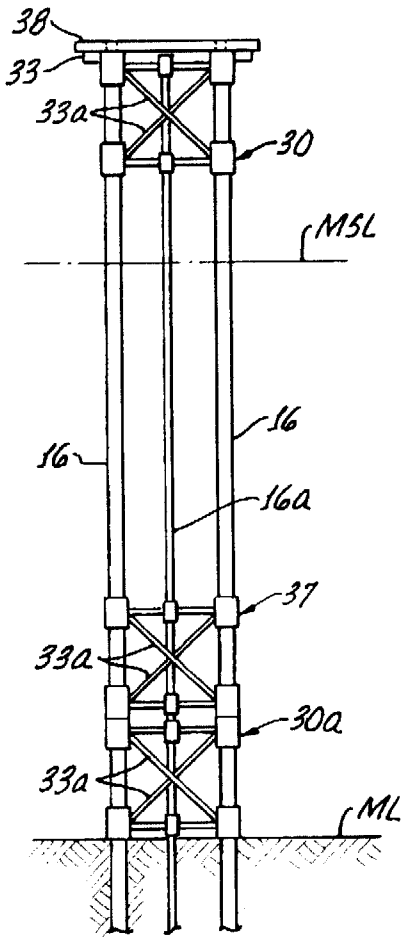
FIG. 5 shows a side view of a partially raised structure.

FIGS. 4, 5, and 6 show side views of three bracing-template structures 30, 37, and **30*a* after underwater installation on exploratory well tubular 16*a*. FIG. 4 shows the bracing-template structures 30, 37, and 30*a* stacked together and resting on the mud line (ML). FIG. 5 shows the bracing-template structures after production wells have been drilled, production well tubulars or conductors 16 run, and the uppermost bracing-template structure 30 has been raised above mean sea level (MSL) and attached to the conductors. FIG. 6 shows the bracing-template structures after the middle structure 37 has been raised and attached to the well conductors 16** or other well tubulars.

In FIG. 4, the exploratory well tubular **16*a* extends upward a distance or height A from the ML. Height A is below the top of the uppermost bracing-template structure 30 which extends upward to a height B above the ML. In a preferred embodiment, height A is about 35 feet above ML, but typically ranges from about 10 to 50 feet above ML prior to installation of the bracing structures, i.e., when the exploratory well tubular 16*a*** is unsupported. Although unsupported exploratory well heights greater than this range are possible, practical considerations typically limit heights outside this range, e.g., unsupported wells protruding above the MSL are subject to damage.

In a preferred embodiment, total or stacked height B is about 45 feet and is composed of the individual heights of the bracing-template structures including individual height C of about 15 feet for the lowermost bracing-template structure **30*a***. Total heights of the preassembled and stacked bracing-template structures typically range from about 45 to 75 feet above ML depending on factors such as water depth and the number of stacked bracing-template structures required for lateral support of the production wells. Although stacked heights greater than this range are possible, practical considerations typically limit stacked heights outside this range, e.g., large stacked heights could result in tipping/damage to the exploratory well and smaller heights could limit the effectiveness of lateral bracing.

The individual bracing-template structure heights, such as C, in a preferred embodiment are about equal to the centerline spacing between the production tubulars 16 (see FIG. 5) and distance D (see FIG. 4) between duct-like guides 32, i.e., usually about 15 feet. A preferred embodiment with these dimensions results in vertical-component braces **33*a* being at a 45 degree angle to the vertical and forming a cross-bracing pattern as shown in FIGS. 4, 5, & 6**. Individual structure heights and production well spacings can typically range from about 10 to 25 feet in other embodiments resulting in different cross-bracing patterns and angles. Other bracing configurations can include vertical-component members so that a cross-bracing angle of about 40 to 50 degrees can be maintained with bracing-template structure heights outside the typical 10 to 25 foot range. These other embodiments can use stacked structures having as many as five or more individual bracing-template structures or as few as one.

Although the uppermost bracing-template structure 30 is typically raised above mean sea level, other raised heights are also possible in alternative embodiments. For example, the raised height may be below MSL and as little as 1 to 10 feet above the mud line if a full working platform is not needed. However, in such a case, the lower portions of the well tubulars would require bracing or lateral support.

A platform 38 provides a working surface for production well drilling, completion, and producing activities. Although the platform 38 is shown in FIG. 4 as preassembled and attached to the uppermost bracing-template structure 30 when it is stacked and placed underwater, the platform may also be attached after the uppermost bracing-template structure 30 is raised above the mean sea level (MSL) and attached to the production well tubulars 16 as shown in FIG. 5. The platform 38 is supported by braces 33 as is shown in FIGS. 3 and 4 and is preferably designed to support production equipment 38*a* as shown in FIG. 6, e.g., pumps, piping, pipeline pig launchers, aids to navigation, control systems, and a crane. A preferred platform 38 provides optional passageways 39 for production well tubulars 16 (see FIGS. 4 & 5), but alternative platforms may not require passageways 39, e.g., if placed above the production well tubulars for helicopter access.

The lowermost bracing-template structure 30*a* is shown in FIG. 4 as including an optional mud mat 40. The mud mat 40 is preferably structurally similar to the platform 38, e.g., both extend about the same lateral distance beyond the spaces between production well tubulars 16 and both are supported by similar braces 33. However, the mud mat 40 may also be significantly different in size and shape from the platform 38 since the functions of each are different, e.g., the mud mat distributing stacked structure loads to the supporting mud, and the work platform supporting production equipment.

In a preferred embodiment, the mud mat 40 is close to, but vertically spaced apart from the lowermost duct-like guides 32. A spaced apart distance between guides 32 and the mud mat 40 allows drill cuttings to be more easily discharged without traveling through the guides 32. The spaced apart distance can typically vary from about 1 to 10 feet, but is preferably in the range from about 3 to 4 feet.

FIG. 5 shows the individual template and bracing structures 30, 37, and 30*a* after production wells have been drilled, at least a portion of the production well tubulars such as well conductors 16 run, the exploratory well tubular 16*a* extended, and the uppermost bracing-template structure 30 raised. Although the optional mud mat 40 (shown in FIG. 4) is not shown in FIG. 5, e.g., the mud mat 40 is not required if the lowermost structure 30*a* is also attached to the production well tubulars 16, in alternative embodiments the mud mat may remain in place.

After the uppermost bracing-template structure 30 is raised above the MSL, it is attached to the production well tubulars 16. In a preferred embodiment, the uppermost bracing-template structure 30 also laterally supports an extension of the exploratory well tubular 16*a*. The extension of the exploratory well tubular 16*a* and its attachment to structure 30 allow the commercial use of the exploratory well tubular for injection or production of oil, gas, or other fluids to/from the formation of interest.

FIG. 6 shows the well and well support assembly after the middle bracing-template structure 37 has been raised and attached to the production well tubulars 16. Typically, the middle bracing-template structure 37 is raised to a height E above the ML which is preferably about one half the height F the uppermost bracing-template structure 30 is raised above the ML. For example, for a MSL height G about 105 feet above the ML and a height of the uppermost bracing-template structure above MSL of about 21 feet, E is preferably about 60 feet. Alternative heights E can typically range from about 30 to 90 feet.

It should be noted that a preferred embodiment of the completed bracing and well structure is devoid of pilings and other anchoring or support structures. By minimizing the use of separate pilings or other structures for support and anchoring of the wells and platform assembly, the cost and time required for producing reservoir fluids are substantially reduced. A plurality of preferred well conductors 16 (especially if they are heavy weight 26 inch or larger diameter tubulars reinforced by cement between the well conductor and a surface casing) fulfills the conventional functions of a well conductor and at the same time supports a working platform when braced by the bracing-template structure(s).

One set of procedures for using the bracing-template structures is discussed with reference to FIGS. 1 through 6. The procedures assume that an offshore exploration well has been drilled and well testing has indicated the commercial potential for an offshore platform having about three production wells drilled in the vicinity of the exploration well. The exploration well is assumed to have temporary conductor supports for a mud line hanger that extends at least about 35 feet above the sea floor or mud line and about 65 to 70 feet below mean sea level. The procedures also assume that the rig used to drill the exploration well, e.g., a jackup rig similar to that shown in FIG. 1, has been moved offsite. However, it should be understood that the bracing-template structures may also be used for drilling and supporting production wells without first removing the jackup rig offsite.

Three bracing template structures (e.g., items 30, 37, and 30*a*) are stacked and installed over the portion of the existing exploration well tubular (e.g., item 16*a*) protruding above the sea floor or mud line (ML). Installation of the stacked structures is preferably accomplished by lifting them off of a floating barge or other vessel one at a time with a drilling rig and lowering them into position beneath MSL. Alternatively, installation of the stacked bracing-template structures may also be accomplished using a crane barge or other lifting mechanism on a vessel or they may be lifted and placed as a stacked unit penetrated by the exploration well tubular 16*a*.

Although the stacked bracing-template structures are preferably fully assembled on shore prior to installation, they could also contain clamps, joints, connectors, and other hardware to allow full or partial assembly of the structures on site. Alternative embodiments of the bracing-template structures (i.e., structures that are less than fully assembled onshore) may require assembly into more than one configuration, e.g., an onshore configuration, a transport (to offshore site) configuration, an installation configuration, a drilling template configuration, and a bracing configuration. Initial configuration(s) of each bracing-template structure would be vertically collapsed (when compared to the preassembled and cross-braced configuration shown in FIG. 4) to allow simplified stacking and underwater placement for use as a drilling template. Later configuration(s), e.g., after a bracing-template structure is raised, can act as support bracing for well tubulars. Reconfigurable bracing-template structures (especially if collapsed to have a total height B significantly less than as shown for the onshore assembled bracing-template structures shown in FIG. 4) should also minimize stacked structure tipping problems. Other on-site or reconfigurable options may include gimballed duct-like guides and remotely-actuated or self-actuated elements, e.g., hydraulic actuators to change configurations.

Still another multi-configuration bracing-template embodiment utilizes telescoping braces in lieu of some rigid tubular braces 33 so that the structure can be raised when the spacing between production wells varies with depth. If production wells have spaced apart distances D at the mud line that are greater than the spaced apart distances near the mean sea level, telescoping braces would be extended for the bracing-template structure to act as a drilling template when placed near the mudline and compressed as the bracing-template structure is picked up and raised. Attaching a raised bracing-template structure having telescoping bracing to the production well conductors 16 would also typically involve fixing the telescoped or compressed position of the braces.

The below-discussed preferred methods of using the bracing-template structures will refer to the items shown in FIGS. 2–6, but alternative configurations of these items may also be used to carry out such methods.

A jackup rig similar to that shown as item 6 in FIG. 1 is initially towed to the exploration well site and positioned in the desired location and orientation for drilling offshore production wells near an exploration well tubular 16*a*. The preferred jackup rig uses a slot and skid-mounted cantilever derrick and rotary table similar to that shown as item 7 in FIG. 1 to allow drilling of several spaced apart wells, e.g., at a spaced apart distance D of about 15 to 25 feet. Rig anchors are set as required to maintain the desired location and orientation of the jackup rig. Divers may also be required to ensure acceptable location, orientation, and anchoring of the rig.

After positioning the jackup rig, the spud cans and legs of the rig are extended to the mud line and the legs are preloaded. After preloading, the working platform of the jackup rig is raised to provide an air gap above mean sea level, e.g., about a 25 foot air gap, and the platform is fixed in the raised position. Raising of the working platform is typically accomplished by supplying pressurized pneumatic or hydraulic fluids to leg-extending actuators.

After the working platform is raised, the cantilever derrick/rotary table is laterally skidded out to a position over the existing exploration well tubular 16*a*. The jackup rig is used to install the three preassembled and stacked bracing-template structures 30, 37, and 30*a* over the exploration well tubular 16*a* at an underwater location resting on the mud line.

The cantilever derrick/rotary table is skidded to another position near one of the furthest outboard positions on the working platform. A nominal 26-inch drill bit with drill pipe sections is made up or assembled, i.e., assembled to form a desired Bottom Hole Assembly (BHA) and string. The BHA is run down to near the top of the stacked bracing-template structures 30, 37 and 30*a* (see FIG. 4), e.g., about 140 feet below the rotary table. The derrick/rotary table is further skidded and the BHA lowered/guided as required to install the BHA through the duct-like guides 32 of the stacked bracing-template structures 30, 37 and 30*a*, e.g., using divers.

A 26-inch hole interval is drilled to a total depth (TD) of about 500 feet below the mud line with the duct-like guides 32 and stacked structures acting as drilling templates. The 26-inch diameter hole interval is drilled about 10 feet deeper than the bottom of the well conductor 16 and casing string 17 or tally which is later run into the interval. The drill string or piping is pulled an amount to allow spacing out of a nominal 36-inch diameter under-reamer. While pulling the drill string out, 9.4 pounds per gallon mud is pumped into the 26-inch diameter hole interval. The pulling rate should not exceed 1.5 times the volume pumping rate to allow pumped mud to fill the hole volume as the drill piping is pulled.

After spacing out, a nominal 36-inch under-reamer is made up. The under-reamer is run in to just below the mud mat 40 or base plate of the bottom bracing-template structure 30*a*. A nominal 36-inch hole is under-reamed to a 36-inch TD to match the 30-inch conductor/casing tally, approximately 350 feet below the rotary table. The BHA should be spaced out to allow the 26-inch bit to reach the previous 26-inch hole TD when the 36-inch hole opener is at the desired 36-inch hole TD. The hole is pumped out with 9.4 ppg mud at a pulling rate not exceeding 1.5 times the volume pumping rate.

A nominal 30-inch conductor string 16 is run and hung off in a conventional manner. The bottom joint of the conductor 16 is open ended and has a window to facilitate cementing the 30 by 36-inch annulus from the bottom joint to the mud line. Preferred conductor joints are about 60 feet long with each joint welded to the adjoining joint. A preferred top joint has a CC-FS pin up with four sets of pad eyes and two welded outlets installed immediately below the pin connector.

A hydraulic conductor tensioning system is rigged up to the pad eyes on the support ring. The 30-inch conductor 16 is tension pulled until a weight indicator is reading only the weight of the blocks and top drive. The hydraulic conductor tensioning system is locked and the CC-FS box landing joint is released from the last joint. The lower bracing template structure 30*a* is attached by divers to the well tubulars 16 by clamping off near the mud line using clamps 35.

A nominal 20-inch diameter surface casing string 17 is run into the hole. Two bow centralizers 20 per surface casing joint are included from a 20-inch shoe to a 30-inch conductor shoe and one rigid centralizer 20 per joint inside the 30-inch conductor 16. An 'A' section, i.e., a nominal 21¼ inch, 200 psi WP casing head, is run into the hole with a landing ring. A running tool and landing joint are made up to the 'A' section and the assembled 'A' section is landed on the 30-inch conductor 16.

Once the 'A' section is landed, the hydraulic conductor tensioning system is pull tensioned until the weight indicator is reading only the weight of the blocks and top drive. The hydraulic tensioning system is locked, the 'A' section running tool released, and the tool is laid down.

A cement stinger on a nominal 5-inch, heavy-weight drill pipe (HWDP) is run into the hole with three centralizers above the stinger to facilitate stabbing a float shoe. The HWDP is run while the 20 by 5-inch annulus is filled with mud or sea water. The HWDP is stung into a float shoe and circulation is broken.

The 20-inch surface casing 17 is cemented in a single stage with 12.0 ppg cement slurry and displaced with seawater. The cement stinger is pulled out of the hole.

A welded outlet below the 30-inch pin is hooked up and a sufficient quantity of 12.0 ppg cement slurry is pumped down the 20 by 30-inch annulus. The hook-up and pumping ensure that cement is circulated to the mud line in the 30 by 36-inch annulus.

After the cement has set, tension is released on the tensioning system. The remainder of the 20 by 30-inch annulus is filled through the welded outlet below the 30-inch pin connector.

The cantilever derrick assembly (see item 7 in FIG. 1) is skidded in, traversing the slot to near another side of the rig (see item 6 in FIG. 1), e.g., about 15 feet from the previous location. The above procedures are repeated to install another well conductor 16 and surface casing 17 in a second location.

The cantilever derrick assembly is again skidded, traversing the slot to near a third side of the rig to a third location about 15 feet from the previous location. The above procedures are repeated to install a third well conductor 16 and surface casing 17 in a third location.

The cantilever derrick assembly is then skidded to traverse the slot to a position nearly over the exploratory well tubular 16*a*. A running tool on the drill piping is made up and run down on slings to the uppermost bracing-template structure 30, which is picked up and positioned immediately below the top of the 30 inch conductor 16. The uppermost bracing-template structure 30 is then attached by clamping the duct guides 32 to the well conductors 16 and slings from the running tool are released.

The middle bracing-template structure 37 is raised simultaneously with the uppermost bracing-template structure 30 by means of slings attached between the uppermost and middle bracing-template structures. The middle bracing-template structure 37 is suspended by the slings while the uppermost bracing-template structure 30 is clamped off. The middle bracing-template structure 37 is then attached in the desired position to the well tubulars 16 by clamping the duct guides to the tubulars. The lowermost bracing-template structure 30*a* is preferably not picked up, but is clamped to the production tubulars 16 near the mud line.

In a preferred procedure, other production well tubulars (such as liners 24 & 26) are run into deeper portions of the borehole 14 after the bracing-template structures 30, 37, and 30*a* are attached to the well conductors 16. Additional joints may also be added to the exploration well tubular 16*a* after the bracing-template structures are attached to the well conductors 16.

Other alternative embodiments of the invention are possible. These include: (1) the use of rectangular, hexagonal, and other bracing-template geometries instead of the depicted triangular and vertically cross-braced configuration shown in FIGS. 3–6, especially when more than three production wells are to be drilled at a platform site; (2) the use of multiple jackup rigs or other drilling platforms to drill production wells and pick up or raise the bracing-template structures, allowing larger distances D between production wells when compared to drilling from a single jackup rig; (3) the use of other means for slidably contacting well tubulars besides cylindrical duct-like guides, such as partial circumference guides, square or other non-cylindrical duct-guides, and slidable contact point guides; and (4) drilling only one or two production wells using a bracing-template structure for three (or more) production wells, inserting heavy wall pipe (or comparable structural members) through the empty duct-like guides of each bracing-template structure, and attaching the picked up or raised structures to the heavy wall pipe (or comparable structural members) to further structurally interconnect the bracing-template structures.

While a preferred embodiment of the invention has been shown and described, and some alternative embodiments also shown and/or described, changes and modifications may be made thereto without departing from the invention. Accordingly, it is intended to embrace within the invention all such changes, modifications and alternative embodiments as fall within the spirit and scope of the appended claims.

What is claimed is:

1. An offshore well structure which comprises:

a plurality of offshore well tubulars extending generally downward from above the water line through an underwater mud line and toward an underground fluid reservoir;

an uppermost bracing structure attached to said offshore well tubulars at a position above the water line; and a lower bracing structure attached to said offshore well tubulars and spaced apart from said uppermost bracing structure, wherein said uppermost and said lower bracing structures have means for stackably mating with one another prior to said uppermost bracing structure being spaced apart from said lower bracing structure and attached to said well tubulars.

2. The offshore well structure of claim 1 wherein at least one of said bracing structures also comprises means for slidably contacting said well tubulars.

3. The offshore well structure of claim 2 wherein said means for slidably contacting are cylindrical duct-like guides for said well tubulars.

4. The offshore well structure of claim 1 comprising at least three offshore well tubulars extending downward from above the water line through said underground mud line and toward said underground fluid reservoir.

5. The offshore well structure of claim 4 substantially devoid of pilings.

6. The offshore well structure of claim 1 which also comprises a mud mat for contacting said underwater mud line.

7. The offshore well structure of claim 1 further comprising a mud mat, said mud mat having an area for contacting said mud line that exceeds the area between said well tubulars.

8. The offshore well structure of claim 1 wherein said uppermost bracing structure serves as a working production platform.

9. The offshore well structure of claim 1 wherein said means for stackably mating comprise telescoping, cylindrical ducts.

10. The offshore well structure of claim 4 wherein said uppermost and said lower bracing structures, when viewed from above, are tripod-shaped.

11. The offshore well structure of claim 1 wherein said uppermost and said lower bracing structures are between about 10 and about 25 feet in height.

12. The offshore well structure of claim 1 devoid of pilings.

13. The offshore well structure of claim 4 containing at least three bracing structures.

14. A method for bracing offshore well tubulars comprising:

placing a plurality of bracing structures stacked on top of each other at an underwater location, at least one of said bracing structures having a duct-like guide for guiding a well tubular moving generally downward with respect to said bracing structures;

drilling at least one well through said duct-like guide wherein a resulting well tubular extends upward through said duct-like guide after said well is at least partially completed;

raising one of said bracing structures wherein said raising results in a raised bracing structure being spaced apart from at least one of the other bracing structures; and attaching the raised bracing structure to at least one well tubular.

15. The method of claim 14 which also comprises the steps of:

running tubulars after said attaching step;

raising a second of said bracing structures while maintaining said well tubular within said duct-like guide wherein said raising results in a second raised bracing structure being spaced apart from the first raised bracing structure; and attaching the second raised bracing structure to at least one well tubular.

16. A method for bracing offshore well tubulars comprising:

stacking upper and lower bracing structures at an underwater position proximate to a mud line, said bracing structures having duct-like guides for guiding a well tubular moving generally downward with respect to said bracing structures;

drilling at least one wellbore through said duct-like guides;

running a first well tubular through said duct-like guides to a position where said first well tubular extends from a location above a water line through said duct-like guides to a location within said wellbore;

running a second well tubular within said first well tubular, wherein a substantially annular space is formed between portions of said well tubulars located above said mud line and below said water line;

attaching said lower bracing structure to said first well tubular;

raising said upper bracing structure to a position above said water line; and attaching said upper bracing structure to said first well tubular.

17. The method of claim 16 wherein said lower bracing structure is attached to said first well tubular at least 10 feet above said underwater position.

18. The method of claim 16 which also comprises the step of attaching a working platform to said upper bracing structure.

19. The method of claim 16 wherein at least a portion of said annular space is filled with a cement slurry prior to said upper bracing structure being raised to a position above the water line.

20. An offshore bracing and well conductor structure comprising:

(a) three or more offshore well conductors which extend generally downward from above the water line through an underwater mud line and toward an underground fluid reservoir;

(b) an uppermost bracing structure attached to said offshore well conductors at a position above the water line;

(c) one or more intermediate bracing structures attached to said offshore well conductors at positions below the water line; and (d) a lowermost bracing structure attached to said offshore well conductors at a position below said one or more intermediate bracing structures, wherein said offshore bracing and well conductor structure is devoid of pilings.

21. The offshore bracing and well tubular structure of claim 20 containing five bracing structures.

22. The offshore bracing and well conductor structure of claim 20 containing three bracing structures.

23. The offshore bracing and well conductor structure of claim 20 wherein said bracing structures, when viewed from above, are rectangular in shape.

24. The offshore bracing and well conductor structure of claim 20 wherein said uppermost bracing structure also serves as a working production platform.

25. The offshore bracing and well conductor structure of claim 20 consisting essentially of elements (a), (b), (c) and (d).

26. The offshore bracing and well conductor structure of claim 24 consisting essentially of elements (a), (b), (c) and (d).

27. The offshore bracing and well conductor structure of claim 20 wherein said bracing structures, when viewed from above, are hexagonal in shape.

28. The offshore bracing and well conductor structure of claim 20 wherein all of said bracing structures are between about 10 and about 25 feet in height.

29. The offshore bracing and well conductor structure of claim 20 wherein element (a) consists essentially of three offshore well conductors.

30. A method for installing and bracing offshore well tubulars which comprises:

placing a plurality of bracing structures on top of each other at an underwater location proximate to the mud line, each of said bracing structures having duct-like guides for guiding well tubulars moving generally downward with respect to said bracing structures;

running well tubulars through said duct-like guides so that said well tubulars extend upward from below the mud line through said duct-like guides;

raising the top bracing structure to a position above the water line and attaching said raised bracing structure to said well tubulars at that position; and raising at least one of the remaining bracing structures to a position below that of said top bracing structure and attaching said bracing structure to said well tubulars at said position below said top bracing structure.

31. The method of claim 30 wherein at least three bracing structures are placed on top of each other at said underwater location.

32. The method of claim 30 wherein each of said bracing structures contains at least three duct-like guides.

33. The method of claim 30 wherein said bracing structures are placed on one another on a mud mat at the mud line.

* * * * *

UNITED STATES PATENT AND TRADEMARK OFFICE

CERTIFICATE OF CORRECTION

PATENT NO. : 5,722,494

DATED : March 3, 1998

INVENTOR(S) : Chris R. Landeck et al.

It is certified that error appears in the above-indentified patent and that said Letters Patent is hereby corrected as shown below:

Column 14, claim 21, line 6, after "well" delete "tubular" and insert in place thereof -- conductor --.

Signed and Sealed this

Fourteenth Day of July, 1998

Bruce Lehman

*Attest:*

BRUCE LEHMAN

*Attesting Officer*

*Commissioner of Patents and Trademarks*